US006120247A

United States Patent [19]

Wheeler

[11] Patent Number: 6,120,247

[45] Date of Patent: Sep. 19, 2000

[54] ROOM COOLING FAN APPARATUS

[76] Inventor: Alton D. Wheeler, 3940 Fox Meadow La., Pasadena, Tex. 77504

[21] Appl. No.: 09/323,286

[22] Filed: Jun. 1, 1999

[51] Int. Cl.[7] ..... B63H 15/00

[52] U.S. Cl. ..... 416/1; 416/96 R

[58] Field of Search ..... 416/5, 95, 96 R, 416/146 R; 165/56, 57, 86, 185, 80.3, DIG. 147, DIG. 150

[56] References Cited

U.S. PATENT DOCUMENTS

| | | | |
|---|---|---|---|
| 3,612,168 | 10/1971 | Peterson | 165/86 |
| 3,835,921 | 9/1974 | Faris et al. | 165/86 |
| 4,782,213 | 11/1988 | Teal | 416/5 |
| 5,545,009 | 8/1996 | Ke | 416/95 |
| 5,690,849 | 11/1997 | DeVilbiss et al. . | |
| 6,026,895 | 2/2000 | Moresco et al. | 165/185 |

*Primary Examiner*—Edward K. Look
*Assistant Examiner*—Hermes Rodriguez
*Attorney, Agent, or Firm*—William W. Haefliger

[57] ABSTRACT

In an air circulating fan assembly, the combination comprises a fan motor and fan blades rotated by the motor; a fluid reservoir and a thermo-electric cooler for cooling the water in the reservoir; and ducting associated with the blades to conduct fluid from the reservoir to heat exchange structure rotated to effect heat transfer between air relatively passing the blades and fluid being returned to the reservoir.

16 Claims, 8 Drawing Sheets

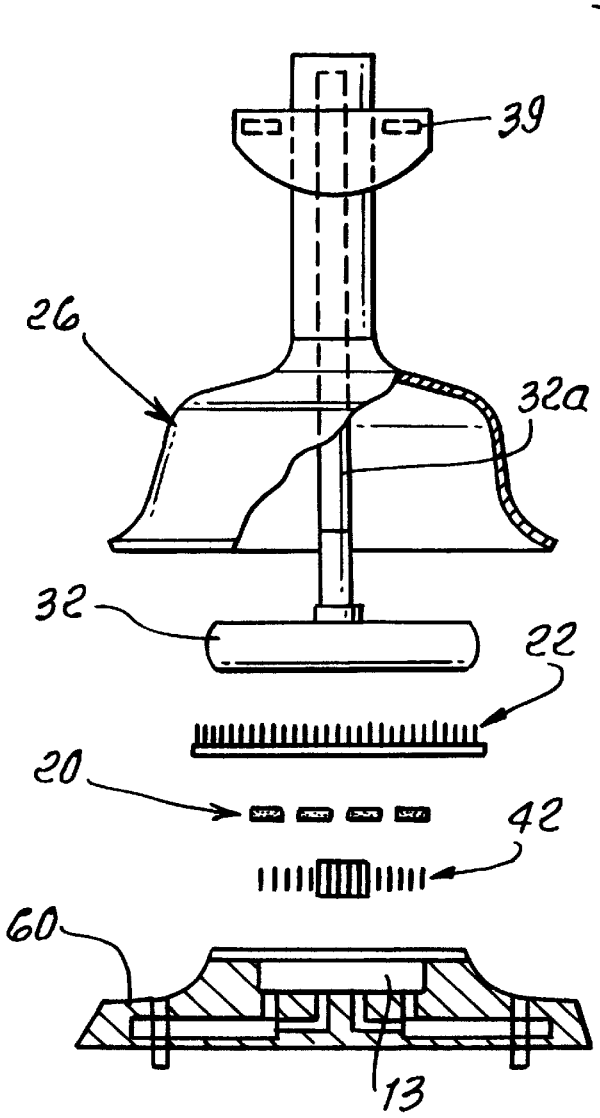
FIG. 10.
FIG. 11.
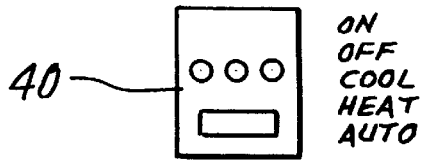

ROOM COOLING FAN APPARATUS

BACKGROUND OF THE INVENTION

This invention relates generally to cooling or heating of air circulating within a chamber such as a room. More specifically, it concerns provision of compact, efficient apparatus to transfer heat to or from air being circulated in the room, and in association with effecting of such circulation.

There is need for compact, efficient apparatus as referred to. Also there is need for provision of such apparatus in or in association with ceiling fans rotating in chambers or rooms, to produce cooling or heating in conjunction with air circulation by fan operation.

SUMMARY OF THE INVENTION

It is a major object of the invention to provide novel apparatus and methods for meeting the above needs.

Basically, the apparatus of the invention is incorporated with an air circulating fan assembly, one example being a ceiling fan, such apparatus including:

a) a fan motor and fan blades rotated by the motor, b) a fluid reservoir and a thermo-electric cooler for cooling the water in the reservoir, c) ducting associated with the blades to conduct cooled fluid from the reservoir to heat exchange structure rotated to effect heat transfer between air relatively passing the blades and fluid being returned to the reservoir.

Another object of the invention is to provide heat sink fins or fin means for receiving heat from the thermo-electric cooler for transferring heat to air flowing adjacent the fins. As will be seen, the thermo-electric cooler is efficiently and compactly positioned generally between the water reservoir and the heat sink fin means. Also the fin means may be advantageously carried to be rotated by the motor, generally above the level of the fan blades.

A further object is to provide an isolation shroud extending about the heat sink fin means to conduct heated air to flow upwardly and to exhaust above the levels of the fan blades and the heat sink fin means. The shroud may serve to conduct a warmed air stream to an exhaust vent located for example at a room ceiling.

Yet another object is to provide the thermo-electric cooler to include multiple chips positioned about a vertical axis of rotation of the fan blades. Such positioning of multiple chip effects efficient heat transfer from fluid in the reservoir to the heat sink fin means.

An additional object is to locate the heat sink fins or fin means above such chips and for transferring heat to air flowing adjacent the fin means.

A yet further object is to provide the ducting to be in part defined by heat exchanger structure carried by the fan blades.

The method of providing air cooling in association with fan structure, in accordance with the invention, includes:

a) providing a fan motor and fan blades rotated by the motor, b) providing a fluid reservoir, c) circulating the fluid when cooled in the reservoir to zones associated with the fan blades to absorb heat from air circulating adjacent the fan blades, and returning the heated fluid to the reservoir, d) providing a thermo-electric cooler positioned to receive heat transfer from fluid in the reservoir, e) providing fins to receive heat transferred from said thermo-electric cooler, and transferring heat from the fins to a stream of air flowing to an exhaust region.

In this regard, the method may include providing a shroud extending about said fins, to isolate said stream of air flowing within the shroud from air circulated by said fan structure in a chamber being cooled.

These and other objects and advantages of the invention, as well as the details of an illustrative embodiment, will be more fully understood from the following specification and drawings, in which:

DRAWING DESCRIPTION

FIG. 4 is a view like FIG. 3, but showing a long blade for assembly, incorporating the assembly;

Figure 9:
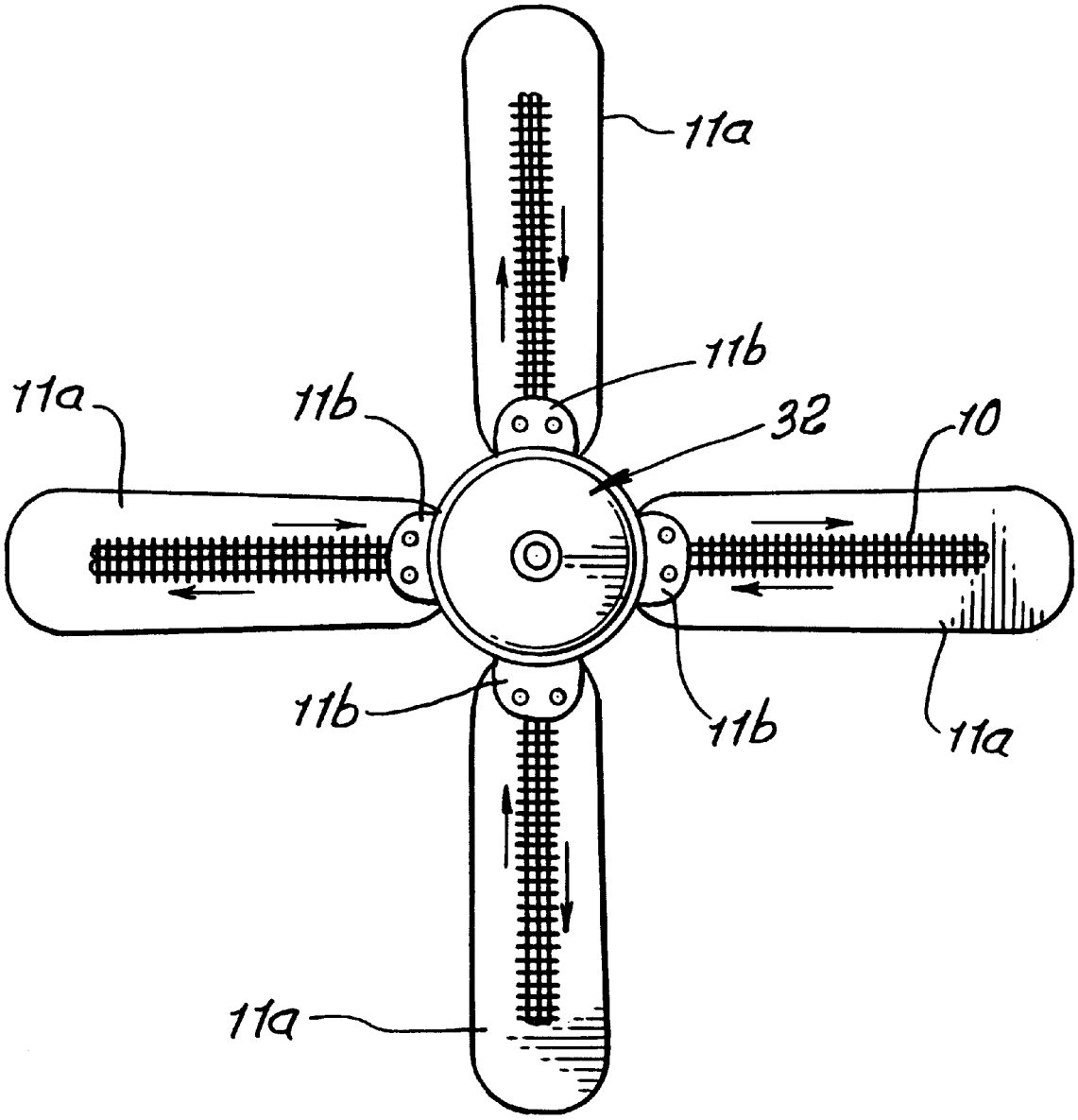
Figure 8:
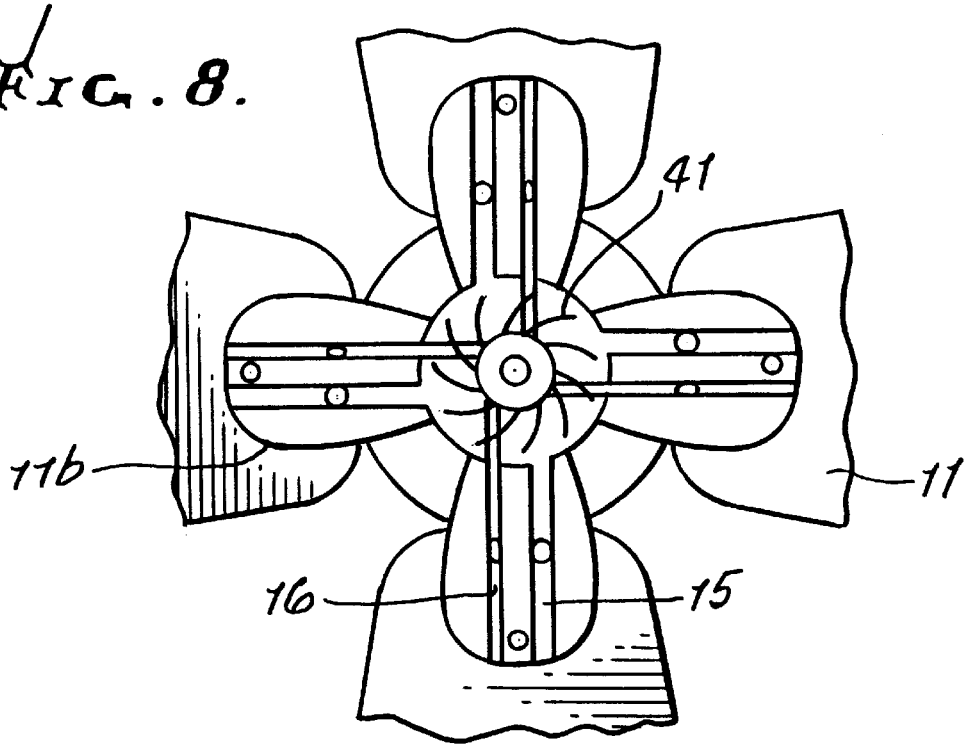
Figure 9:
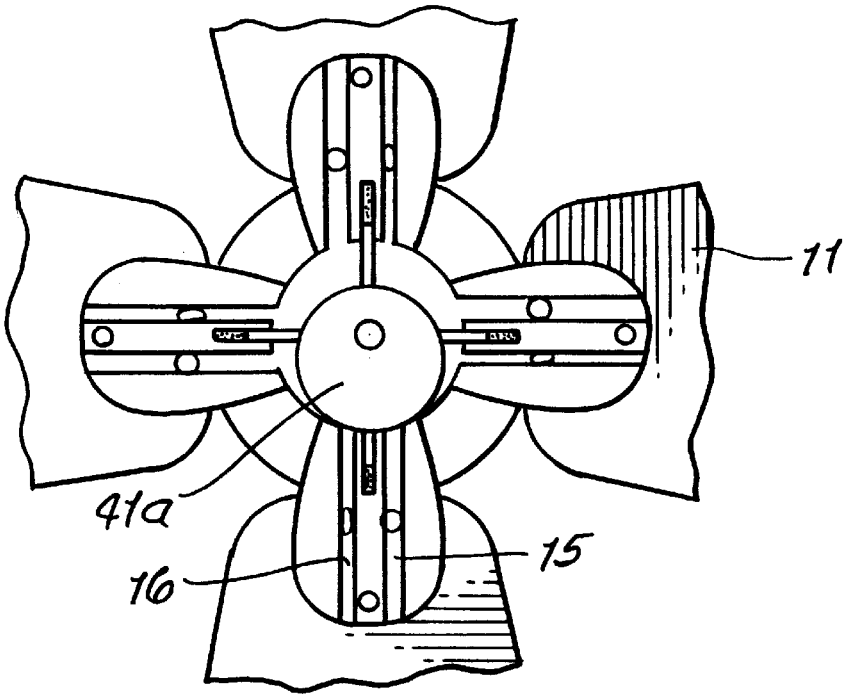

FIG. 8 schematically shows use of a centrifugal pump, for cooling fluid displacement in ducting;

FIG. 9 schematically shows use of a positive displacement pump, for cooling fluid displacement in ducting;

FIG. 10 is an elevation schematically showing elements of the assembly, in exploded form;

FIG. 11 shows a control panel; and

Figure 12:
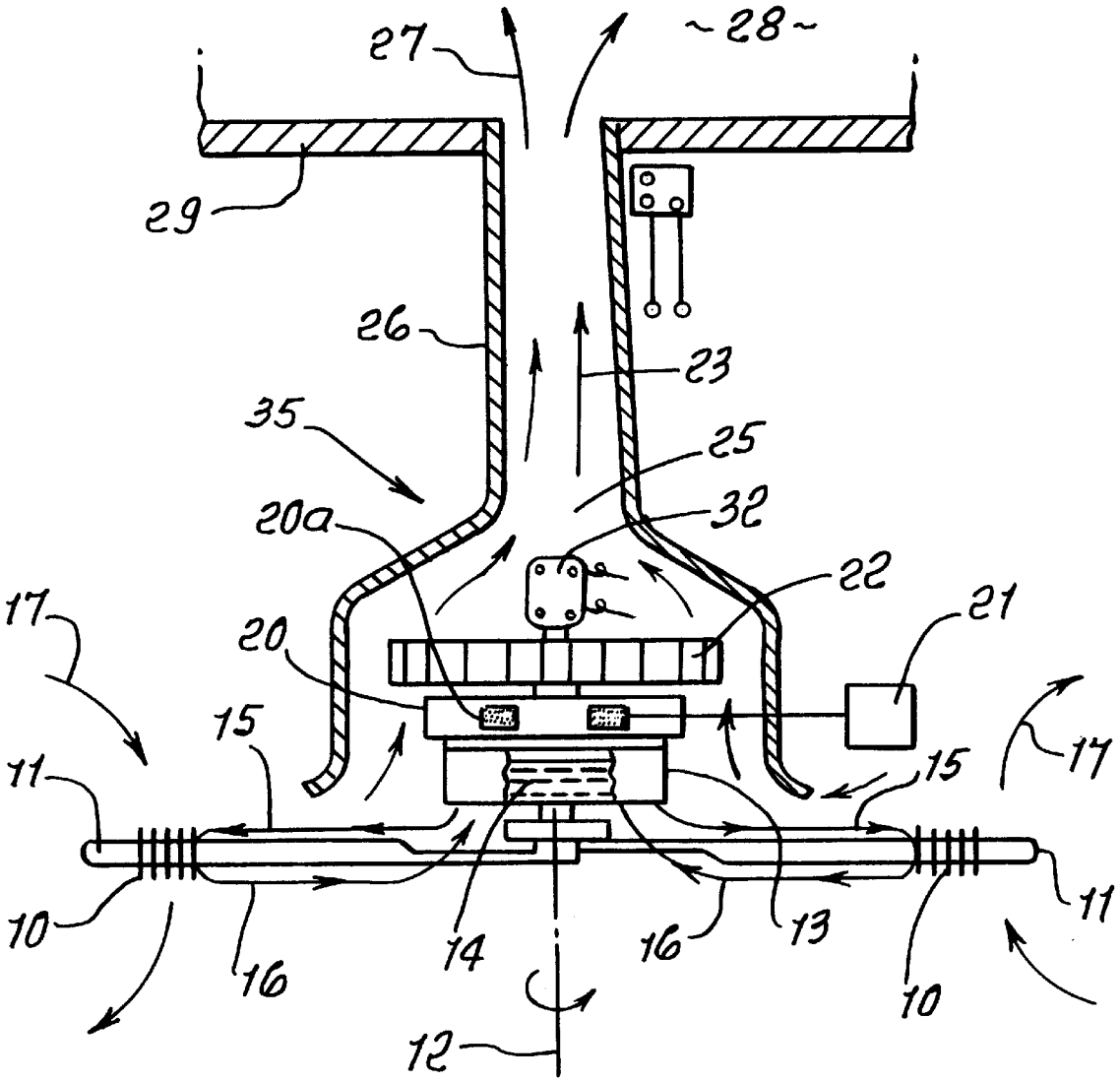

FIG. 12 is a schematic diagram of heat exchange and flow.

DETAILED DESCRIPTION

Referring first to the FIG. 12 schematic, it shows the following:

1. Heat exchanger 10 carried by fan blades 11 rotating about vertical axis 12.
2. A reservoir 13 for coolant fluid 14, which flows at 15 from the reservoir 13 to the heat exchangers 10, and flows at 16 from the exchangers back to the reservoir 13. Heat removed from circulating air 17 in the room 18 is thereby transferred to the pool of fluid in the reservoir. Such fluid may consist of water.
3. Thermo-electric means 20, such as chips 20*a,* distributed about axis 12 and located just above the reservoir, to receive heat by conduction, cooling the reservoir fluid. Electronic circuitry to drive the means 20 is indicated at 21.
4. Heat sink fins are 22 located just above the means 20, i.e. chips 20*a,* to receive heat, as by conduction, from the chips 20*a*. Heat received by the metallic fins is transferred by conduction and radiation from the fins to a stream or streams 23 of air passing adjacent the fins. Such fins may be rotated to enhance the heat transfer effect.
5. The heated stream or streams 23 of air are circulated and driven upwardly, as by the rotating fins, within a rise space 25 surrounded by a shroud 26. The streams 23 may be exhausted as at 27, and typically into a space 28 above a ceiling 29. Flow in space 28 may be conducted to the room exterior.
6. A motor 32 to rotate the fan blades 11 and heat sink fins 22, about vertical axis 12.

Figure 1:
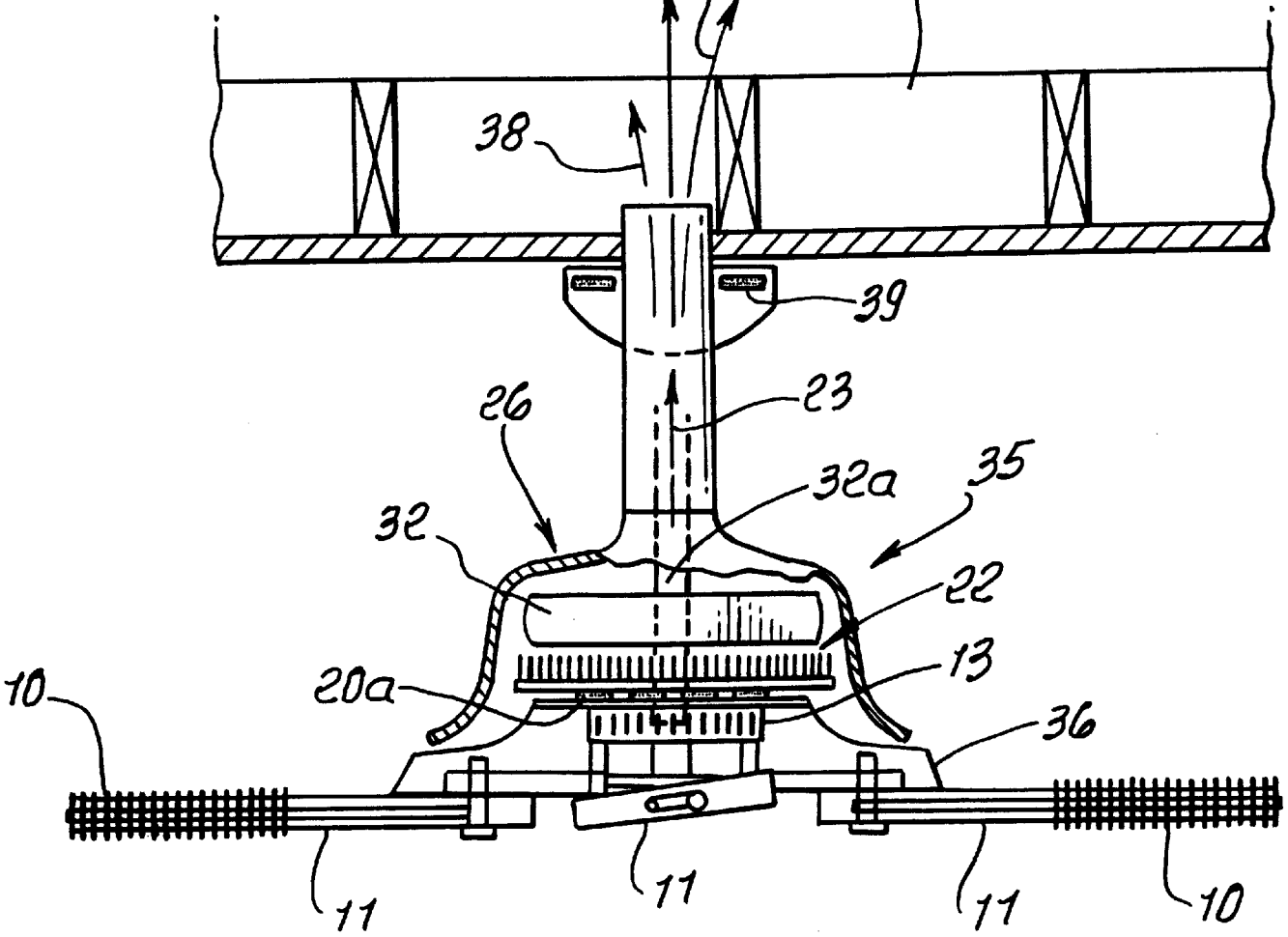
FIG. 1 is an elevation, partly in section, taken through an assembly incorporating the invention.

FIG. 1 shows the above elements as an assembly or structure 35 projecting below ceiling 29. A rotary support for the fan blades appears at 36. Heated air streams 23 exhaust upwardly at 38. Electronic controls are provided at 39. See also the FIG. 11 control panel 40.

Figure 2:
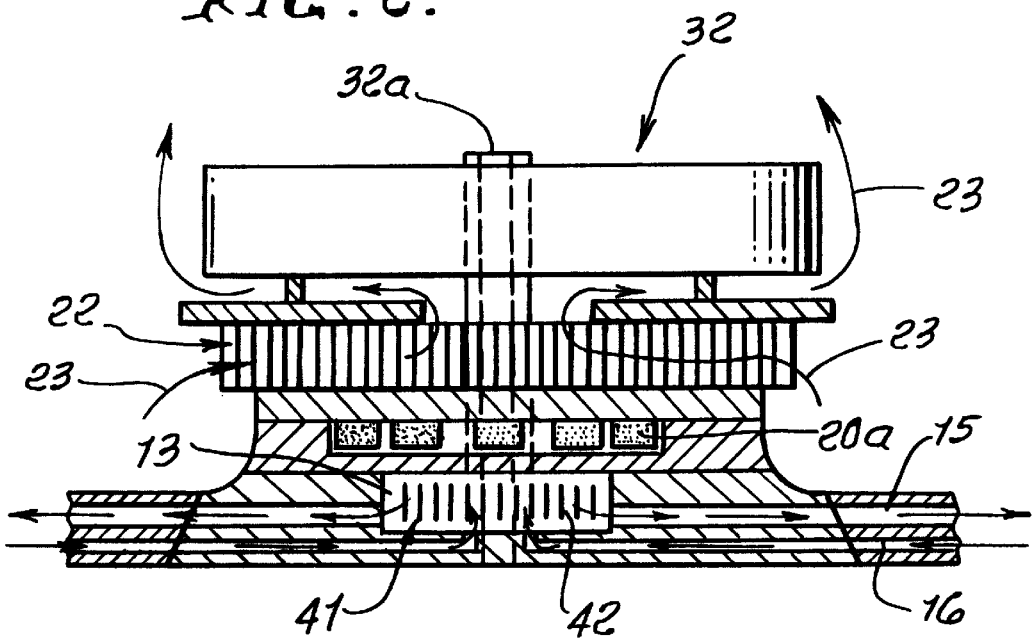
FIG. 2 is an elevation taken in section, to schematically show elements of the assembly.
Figure 3:
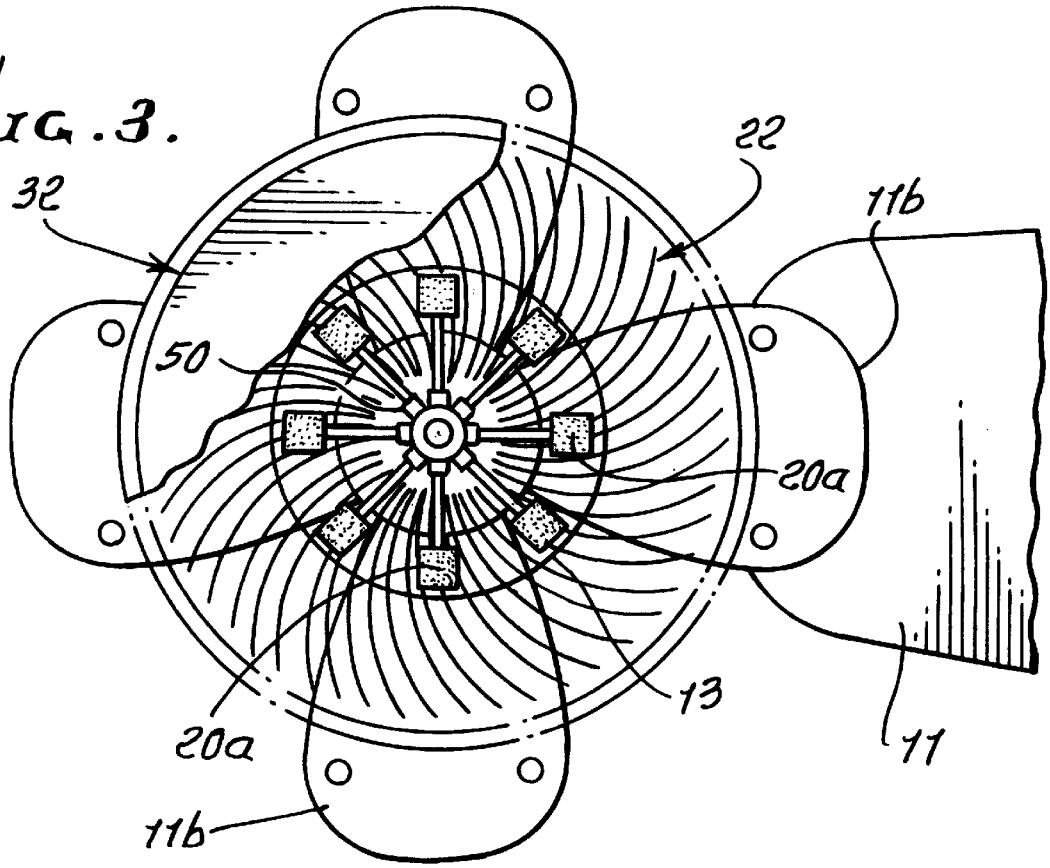
FIG. 3 is a top plan view of the assembly, schematically elements of the assembly.

FIGS. 2 and 3 show the FIG. 1 elements in greater detail. A rotary pump 41 is provided in the reservoir with a rotary impeller 42 for driving the fluid or liquid, such as water, into the ducts 15 leading to heat exchanger coils 10 carried by the blades. See also the return ducts 16. FIG. 3 shows the thermo-electric chips 20*a* distributed about the vertical axis. Chips 20*a* rotate with the blades. Slip ring 50 conducts electric current to the chips.

Figure 5:
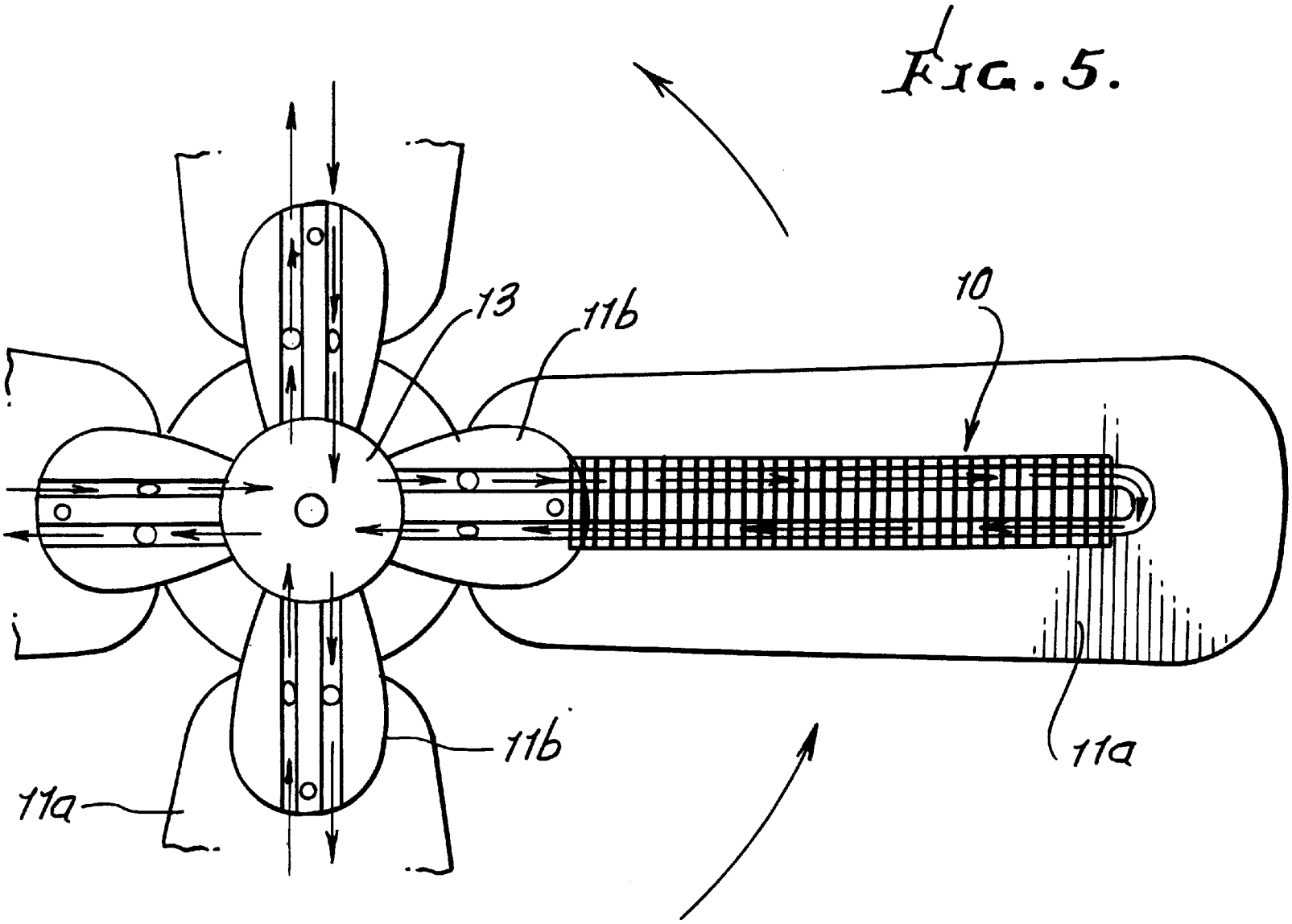
FIG. 5 is a plan view schematically showing fluid, such as water, circulation in ducting associated with the fan blades.
Figure 6:
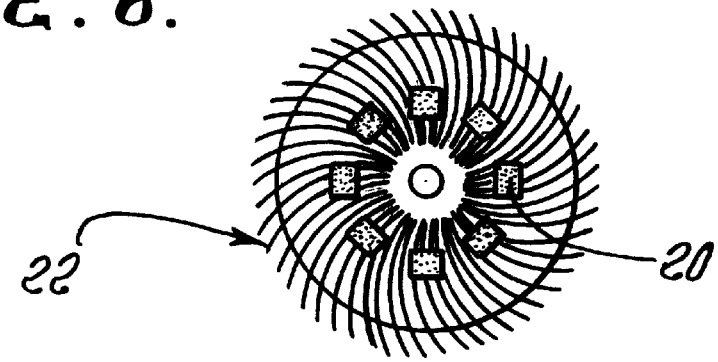
FIG. 6 is a schematic plan view showing positioning of thermo-electric chips relative to heat sink fins.
Figure 7:
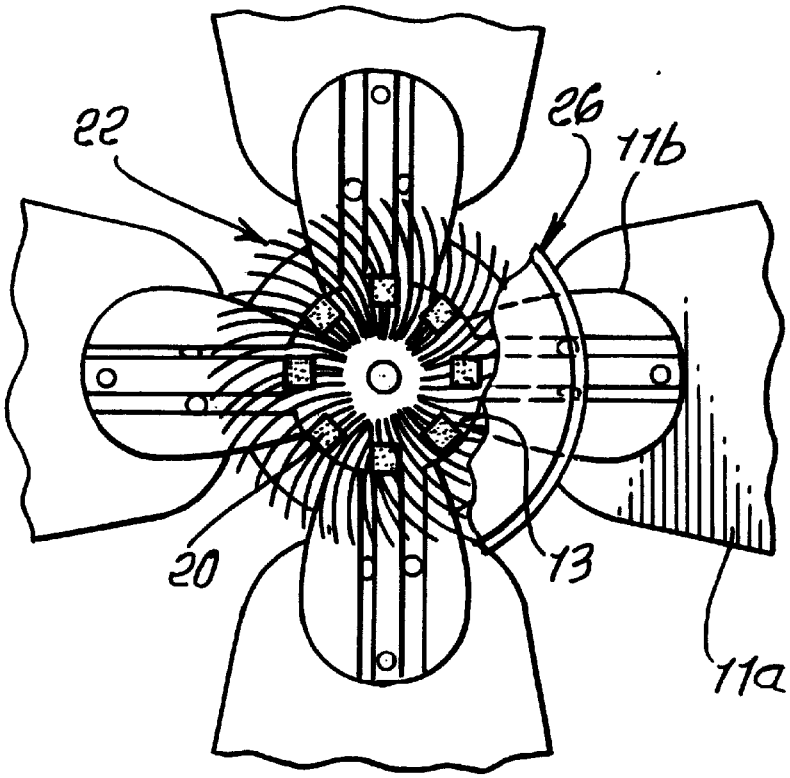
FIG. 7 is like FIG. 6, but adds the positioning of fan blades.

FIG. 4 is like FIG. 3, but shows elongated fan blades 11*a*. Structure 111 connects the motor driven shaft 32*a* to the blades. FIGS. 5, 6 and 7 also show details as to placement of the chips 20*a* and the curved, metallic heat sink blades, and the ducts 15 and 16. The tubular outflow ducts 15 may be larger in cross-section than the tubular return ducts 16. Accordingly, centrifugal force acting on water in larger ducts 15 acts or aids in return flow in ducts 16 to the reservoir.

FIG. 8 shows in plan view the use of a centrifugal impeller pump 41, as referred to, in the reservoir. FIG. 9 shows the alternative use of a positive displacement pump 41*a*.

FIG. 10 is an axially exploded view of the described elements. It also shows a pump and blade attachment support or casting 60.

The thermo-electric means, or chips are shown, and may be of the commercial type supplied by Thermo Tek, Inc., Carollton, Tex. See also U.S. Pat. No. 5,690,849.

The described device may be used as a room heater, by operation of the means 20 in heat-flow reverse relation to the other elements.

I claim:

1. In an air circulating fan assembly, the combination comprising a) a fan motor and fan blades rotated by the motor, b) a fluid reservoir and a thermo-electric cooler for cooling the water in the reservoir, c) ducting associated with the blades to conduct fluid from the reservoir to heat exchange structure rotated to effect heat transfer between air relatively passing the blades and fluid being returned to the reservoir.

2. The combination of claim 1 including heat sink fins for receiving heat from the thermo-electric cooler for transferring heat to air flowing adjacent the fins.

3. The combination of claim 2 wherein said thermo-electric cooler is positioned generally between the fluid reservoir and the heat sink fins.

4. The combination of claim 2 wherein the fins are carried to be rotated by the motor, generally above the level of the fan blades.

5. The combination of claim 2 including a shroud extending about the heat sink fins to conduct heated air to flow upwardly and to exhaust above the levels of the fan blades and the heat sink fins.

6. The combination of claim 1 wherein said thermo-electric cooler includes multiple chips positioned about a vertical axis of rotation of the fan blades.

7. The combination of claim 5 including a ceiling vent for conducting said exhaust out of a chamber in which the fan is rotating.

8. The combination of claim 1 wherein said ducting is in part defined by heat exchanger structure carried by the fan blades.

9. The combination of claim 6 including heat sink fin means positioned above the chips for receiving heat from the chips and for transferring heat to air flowing adjacent the fin means.

10. The combination of claim 9 wherein the chips are located above the reservoir.

11. The combination of claim 10 wherein the heat sink fin means are located above the chips.

12. The combination of claim 10 wherein the reservoir is located generally at the level of the fan blades.

13. The combination of claim 1 including a pump operating to pump fluid from the reservoir to the ducting.

14. The combination of claim 1 wherein the ducting includes an outflow duct of relatively larger cross-section, and a return flow duct of relatively lesser cross-section, said ducts being in series communication.

15. The method of providing air cooling in association with fan structure, that includes a) providing a fan motor and fan blades rotated by the motor, b) providing a fluid reservoir, c) circulating fluid when cooled in the reservoir to zones associated with the fan blades to absorb heat from air circulating adjacent the fan blades, and returning the heated fluid to the reservoir, d) providing a thermo-electric cooler positioned to receive heat transfer from fluid in the reservoir, e) providing fins to receive heat transferred from said thermo-electric cooler, and transferring heat from the fins to a stream of air flowing to an exhaust region.

16. The method of claim 15 including providing a shroud extending about said fins, to isolate said stream of air flowing within the shroud from air circulated by said fan structure in a chamber being cooled.

* * * * *